US009697701B2

(12) United States Patent
Gomez

(10) Patent No.: US 9,697,701 B2
(45) Date of Patent: Jul. 4, 2017

(54) FOOT ACTUATED DOORBELL BUTTON ASSEMBLY

(71) Applicant: Tony Gomez, Salt Lake City, UT (US)

(72) Inventor: Tony Gomez, Salt Lake City, UT (US)

( * ) Notice: Subject to any disclaimer, the term of this patent is extended or adjusted under 35 U.S.C. 154(b) by 0 days.

(21) Appl. No.: 14/870,397

(22) Filed: Sep. 30, 2015

(65) Prior Publication Data

US 2016/0098905 A1 Apr. 7, 2016

Related U.S. Application Data

(60) Provisional application No. 62/059,094, filed on Oct. 2, 2014.

(51) Int. Cl.

| | |
|---|---|
| ***G08B 3/00*** | (2006.01) |
| ***G08B 3/10*** | (2006.01) |
| ***G05G 1/44*** | (2008.04) |

(52) U.S. Cl.
CPC *G08B 3/10* (2013.01); *G05G 1/44* (2013.01)

(58) Field of Classification Search
None
See application file for complete search history.

(56) References Cited

U.S. PATENT DOCUMENTS 3,391,674 A * 7/1968 Burleigh ..... A01K 1/035 119/174
3,841,172 A * 10/1974 Pilch ..... G05G 1/30 74/512
4,067,522 A * 1/1978 Williams ..... B61L 29/24 200/332
4,400,696 A * 8/1983 Klingensmith ..... A01K 1/035 119/174
4,414,921 A * 11/1983 Cozzi ..... A01K 15/02 119/719
4,686,504 A * 8/1987 German ..... A01K 1/035 200/61.62
4,744,015 A * 5/1988 Lai ..... F21S 9/02 200/86 R
4,827,243 A * 5/1989 Cheng ..... H01H 13/70 200/345
4,924,214 A * 5/1990 Hill ..... G08B 13/10 200/86.5
5,264,824 A * 11/1993 Hour ..... G08B 13/10 200/85 R
5,423,231 A * 6/1995 Helfrich ..... A61C 1/0023 200/86.5
5,475,369 A * 12/1995 Baker ..... A01K 1/035 119/174
5,604,478 A * 2/1997 Grady ..... A01K 15/02 119/174
5,635,777 A * 6/1997 Telymonde ..... H01H 3/14 200/86.5

(Continued)

*Primary Examiner* — Curtis King
(74) *Attorney, Agent, or Firm* — Brian Tucker; Kirton McConkie

(57) ABSTRACT

A foot actuated doorbell button assembly can comprise a housing that contains a button as well as a pedal that can be stepped on to actuate the button. The housing can be configured to mount to a wall or to the ground so that the pedal is positioned at or near the ground where it can be easily stepped on. The housing can contain wired or wireless circuitry to allow the doorbell button assembly to be used with virtually any of the existing doorbell assemblies currently available.

12 Claims, 11 Drawing Sheets

(56) References Cited

U.S. PATENT DOCUMENTS 5,952,926 A * 9/1999 Syverson ..... A01K 1/035 119/174
5,983,749 A * 11/1999 Holtorf ..... G05G 1/30 74/478
6,010,024 A * 1/2000 Wang ..... B65F 1/163 220/23.87
6,094,139 A * 7/2000 Moore ..... G08B 3/10 340/286.11
6,240,880 B1 * 6/2001 Jones ..... A01K 15/02 119/712
6,433,692 B1 * 8/2002 Kenum ..... A01K 1/035 340/328
6,445,302 B2 * 9/2002 Vena ..... 119/174
6,452,120 B1 * 9/2002 Chen ..... G05G 1/30 200/52 R
6,549,502 B1 * 4/2003 Lagasse ..... A47L 23/266 369/63
6,606,030 B2 * 8/2003 Vena ..... A01K 15/02 119/174
6,683,240 B1 * 1/2004 Cubranich ..... G09B 15/06 84/422.1
7,380,682 B2 * 6/2008 Lin ..... B65F 1/163 220/244
7,781,941 B2 * 8/2010 Horvath ..... A61B 17/00 310/319
8,465,473 B2 * 6/2013 Horvath ..... A61B 17/32002 200/86.5
2004/0233059 A1 * 11/2004 Smith ..... A01K 15/021 340/573.3
2007/0125782 A1 * 6/2007 Wong ..... B65F 1/163 220/263
2008/0007408 A1 * 1/2008 Hwang ..... E05C 3/043 340/572.1
2009/0051548 A1 * 2/2009 Dundon ..... A01K 15/02 340/573.3
2012/0060671 A1 * 3/2012 Sakai ..... G10C 3/26 84/746
2012/0085196 A1 * 4/2012 Watanabe ..... B60K 26/021 74/513
2015/0033903 A1 * 2/2015 Byun ..... G05G 5/03 74/513
2015/0277479 A1 * 10/2015 Viethen ..... B60K 26/021 74/560
2016/0206083 A1 * 7/2016 Gomez ..... A45F 5/00

* cited by examiner

FOOT ACTUATED DOORBELL BUTTON ASSEMBLY

CROSS-REFERENCE TO RELATED APPLICATIONS

This application claims the benefit of U.S. Provisional Patent Application No. 62/059,094 which was filed on Oct. 2, 2014.

BACKGROUND

A doorbell is typically an electronic device. A doorbell button is typically mounted to a wall next to an exterior door and serves as an actuator for causing the doorbell to emit a sound. Two general types of doorbells exist: a wired doorbell, and a wireless doorbell. In a wired doorbell, the doorbell button is typically comprised of a housing, a switch to which the wires are connected, and the button. When the button is pressed in a wired doorbell configuration, the switch is closed thereby allowing current to flow through the circuitry of the doorbell which causes a sound to be emitted. In a wireless doorbell, the doorbell button is typically comprised of a housing, transmitter circuitry, and the button. When the button is pressed in a wireless doorbell configuration, the transmitter circuitry transmits a wireless signal that is received by corresponding receiver circuitry. In response to receiving the wireless signal, the receiver circuitry causes a sound to be emitted.

BRIEF SUMMARY

The present invention extends to a foot actuated doorbell button assembly. A doorbell button assembly in accordance with one or more embodiments of the present invention can comprise a housing that contains a button as well as a pedal that can be stepped on to actuate the button. The housing can be configured to mount to a wall or to the ground so that the pedal is positioned at or near the ground where it can be easily stepped on. The housing can contain wired or wireless circuitry to allow the doorbell button assembly to be used with virtually any of the existing doorbell assemblies currently available.

In one embodiment, the present invention is implemented as a foot actuated doorbell button assembly that comprises a housing, a button contained within the housing, the button configured to cause a doorbell to be actuated when the button is depressed; and a pedal that extends out from the housing, the pedal being coupled to the housing in a pivoting connection, the pivoting connection biasing the pedal into an unactuated position and allowing the pedal to be depressed downwardly into an actuated position, the pedal including an extension that depresses the button when the pedal is depressed into the actuated position.

In another embodiment, the present invention is implemented as a foot actuated doorbell button assembly that comprises a housing, a pedal that extends out from the housing, the pedal being coupled to the housing in a pivoting connection, the pivoting connection biasing the pedal into an unactuated position and allowing the pedal to be depressed downwardly into an actuated position, the pedal including an extension that approaches or contacts the housing when the pedal is depressed, and circuitry for detecting when the extension has approached or contacted the housing, and in response, causing a sound to be emitted.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

FIGS. 1A, 1B, 2A, and 2B illustrate a foot actuated doorbell button assembly 100 in accordance with one or more embodiments of the present invention. Assembly 100 generally comprises a housing 101, a pedal 102, and a button 103. Housing 101 functions as a mounting plate for mounting assembly 100 to a wall or other structure. For example, a back surface 101*c* of housing 101 may be placed against a wall near an exterior door. Back surface 101*c* may include an adhesive for adhering housing 101 to the wall, or housing 101 may include one or more holes (not shown) for securing housing 101 to the wall using one or more fasteners such as screws. A bottom surface 101*d* of housing 101 may be positioned against the ground or other floor surface to provide additional support to assembly 100.

Pedal 102 is connected to housing 101 using a pivoting connection. In this way, when stepped on, pedal 102 will pivot downward. Pedal 102 includes an extension 102*a* that extends from a bottom surface of the pedal. Extension 102*a* is curved towards housing 101 and may include a tip 102*b* at its bottom end. Because extension 102*a* is curved towards housing 101, when pedal 102 is pivoted downward, tip 102*b* can contact and depress button 103. In some embodiments, tip 102*b* can be formed of a compressible material such as rubber to minimize the impact on button 103 when pedal 102 is depressed.

Housing 101 may also include a protrusion 101*a* that protrudes from a front surface of the housing. Protrusion 101*a* is positioned underneath pedal 102 and forms a surface that pedal 102 will contact when depressed. Protrusion 101*a* can therefore serve to limit the downward movement of pedal 102 to prevent extension 102*a* from damaging button 103. In some embodiments, protrusion 101*a* can include a chamfered edge 101*b*. Chamfered edge 101*b* can be formed to have an angle that matches the angle of pedal 102 when pedal 102 contacts protrusion 101*a*. In this way, chamfered edge 101*b* increases the surface area of protrusion 101*a* that contacts pedal 102 thereby minimizing the risk that pedal 102 may be bent or otherwise damaged when contacting protrusion 101*a*.

Figure 1A:
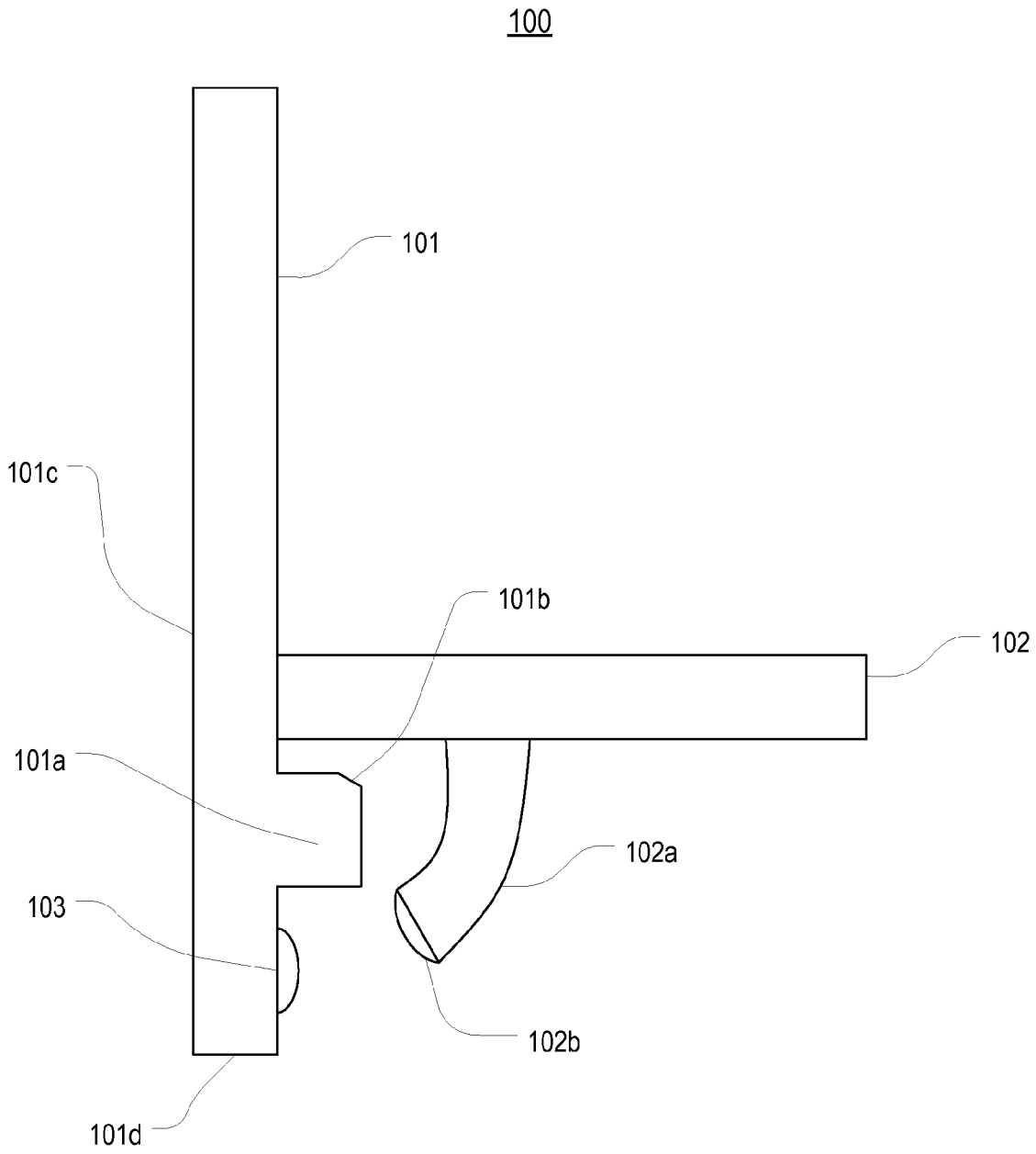
FIGS. 1A and 1B illustrate side views of a foot actuated doorbell button assembly in an unactuated and an actuated position respectively.
Figure 2A:
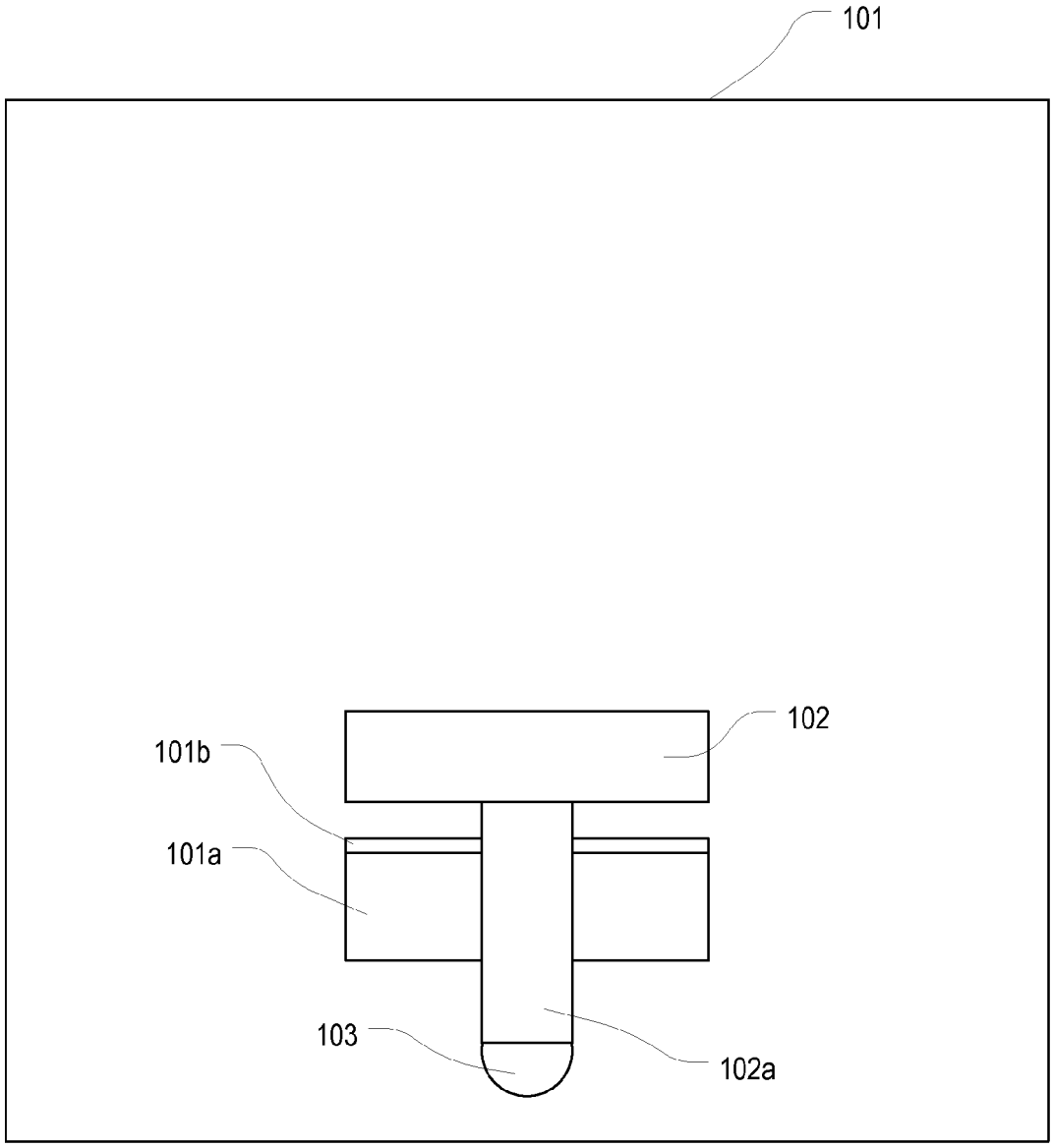
FIGS. 2A and 2B illustrate front views of the foot actuated doorbell button assembly that correspond with the side views of FIGS. 1A and 1B respectively.

FIGS. 1A and 2A illustrate side and front views respectively of assembly 100 when pedal 102 is in an unactuated position. Pedal 102 may be biased to the position shown in FIGS. 1A and 2A so that a downward force is required to actuate button 103.

Figure 1B:
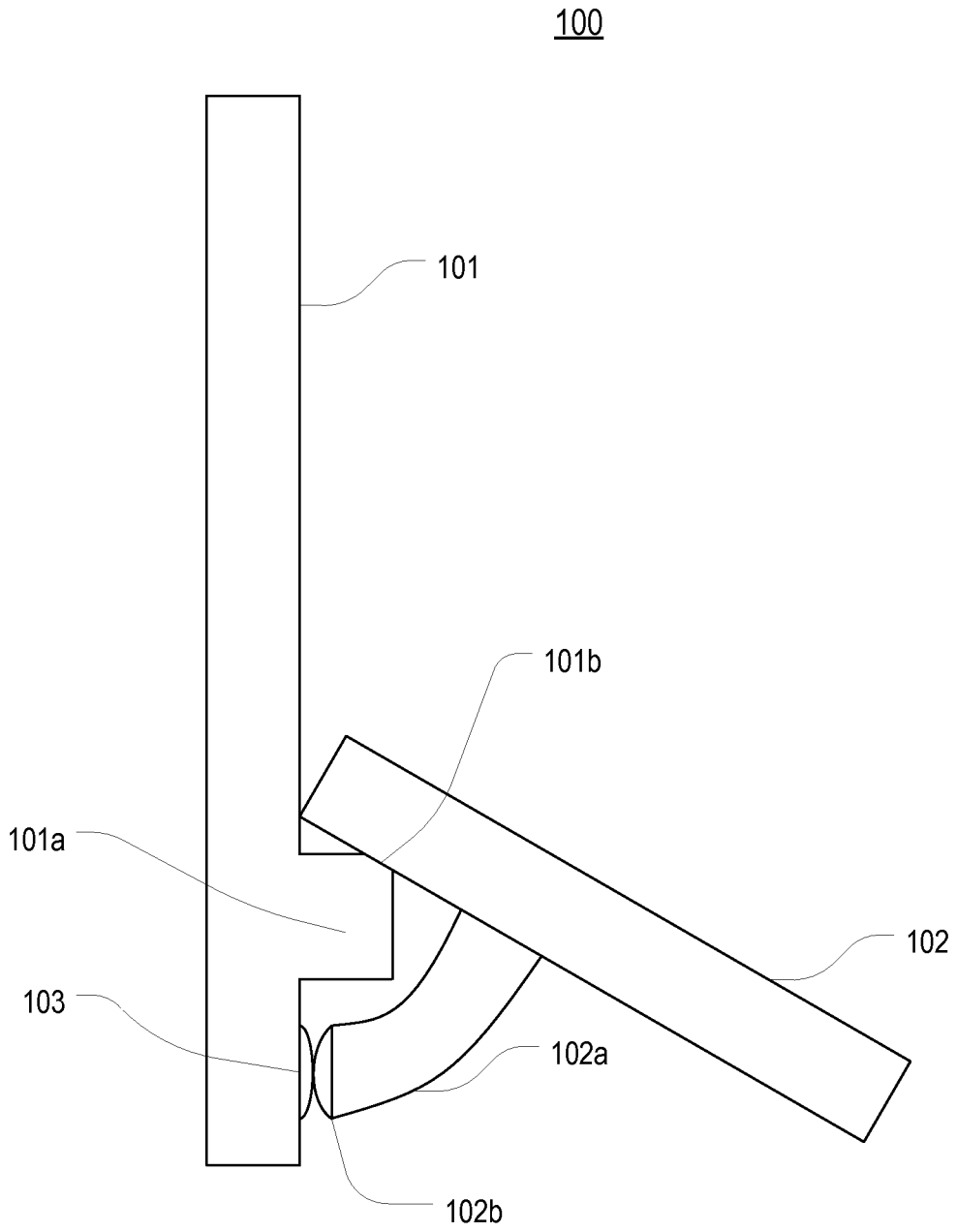
Figure 2B:
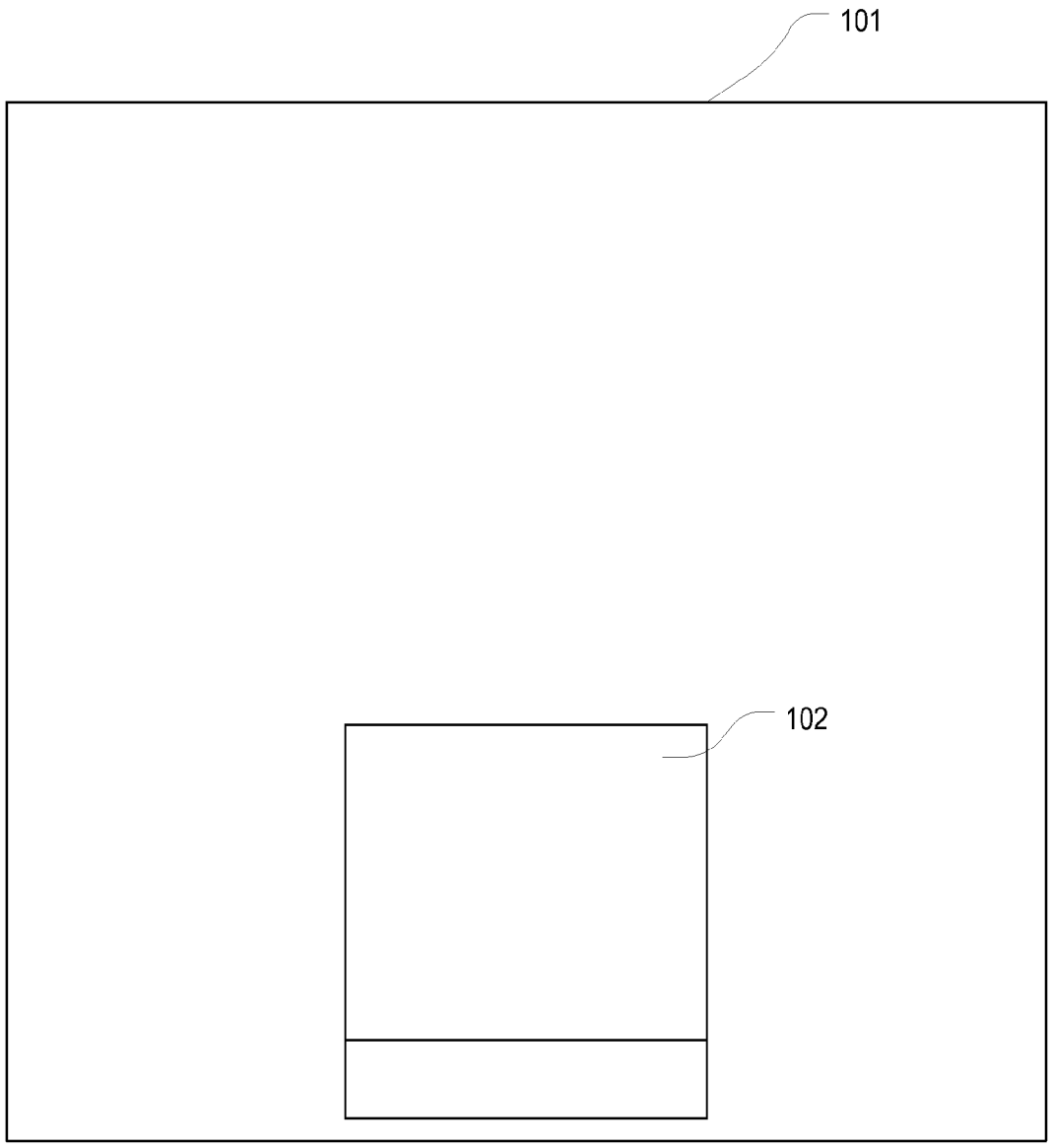

FIGS. 1B and 2B illustrate side and front views respectively of assembly 100 when pedal 102 is in an actuated position. Pedal 102 may reach this actuated position when stepped on. As shown, in the actuated position, pedal 102 has pivoted downward until its bottom surface has contacted chamfered edge 101*b*. In this actuated position, tip 102*b* depresses button 103 to thereby cause the doorbell to ring or otherwise emit a sound. Protrusion 101*a* and/or chamfered edge 101*b* can be positioned so that pedal 102 will be stopped at a point where extension 102*a* will depress button 103 sufficiently to activate circuitry within housing 101, but will not cause damage to button 103 or housing 101.

Figure 3A:
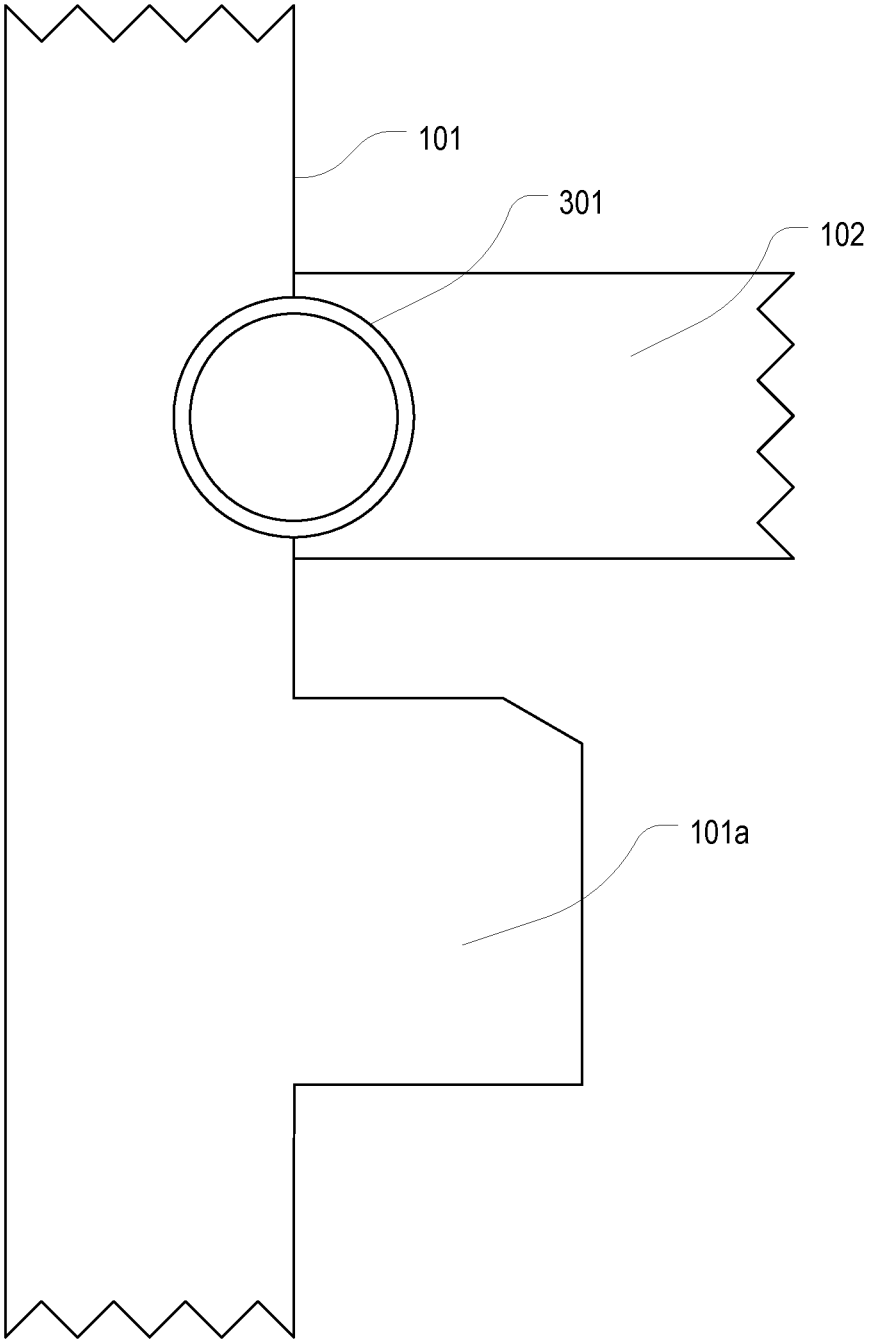
FIG. 3A illustrates an example of a biasing means that can be used to bias the pedal of the foot actuated doorbell button assembly in the unactuated position.
Figure 3B:
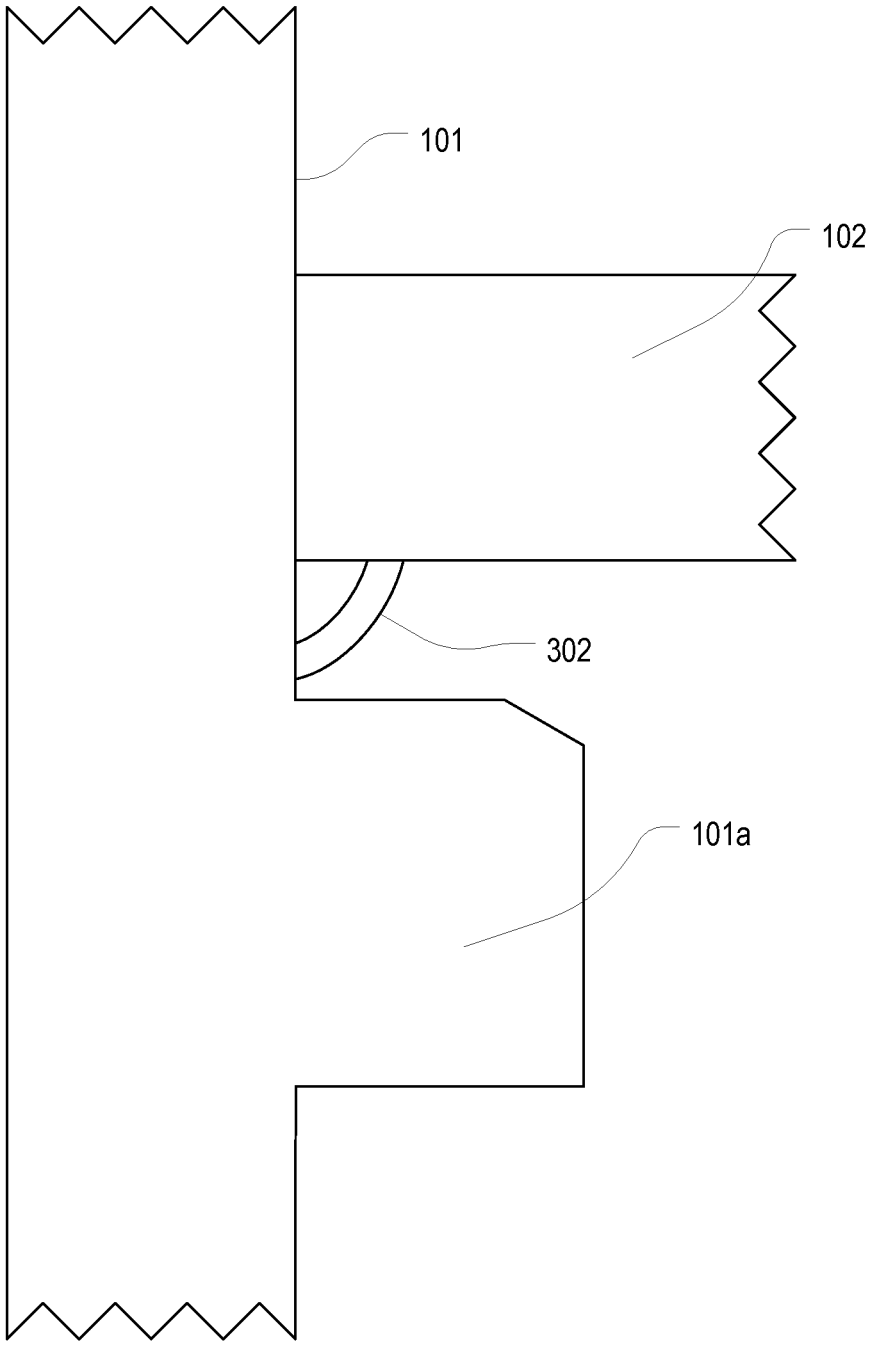
FIG. 3B illustrates another example of a biasing means that can be used to bias the pedal of the foot actuated doorbell button assembly in the unactuated position.

Pedal 102 may be connected to housing 101 in a biased configuration in various ways. For example, as shown in FIG. 3A, a spring hinge 301 may be positioned within housing 101 and pedal 102. Spring hinge 301 may bias pedal 102 into the unactuated position shown in FIGS. 1A and 2A. FIG. 3B illustrates another example where an external spring 302 extends between the front surface of housing 101 and the bottom surface of pedal 102. External spring 302 may also bias (i.e. push) pedal 102 into the unactuated position shown in FIGS. 1A and 2A. Although not shown, an external spring 302 could alternatively or additionally extend between the front surface of housing 101 and the top surface of pedal 102 to bias (i.e., pull) pedal 102 into the unactuated position. An external spring may also be positioned underneath pedal 102 so that the spring is compressed between pedal 102 and the ground when pedal 102 is depressed. Other biasing means could also be used including magnets and biased pulleys which retract pedal 102 to the unactuated position after the pedal has been depressed.

Figure 4:
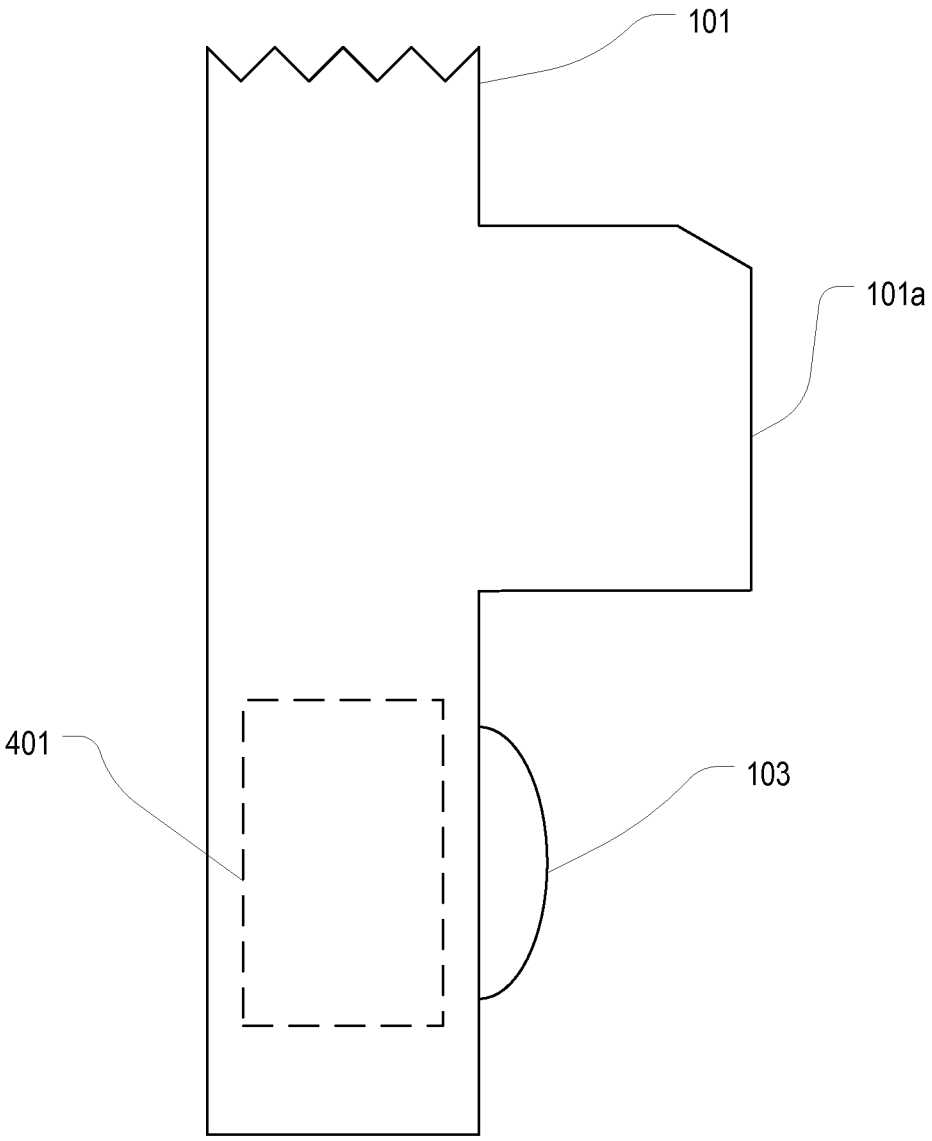
FIG. 4 illustrates circuitry that can be included within the housing of the foot actuated doorbell button assembly.

FIG. 4 illustrates an example of circuitry 401 that can be included within housing 101. When assembly 100 provides a wired configuration, circuitry 401 can comprise a switch that is closed when button 103 is depressed. When assembly 100 provides a wireless configuration, circuitry 401 can comprise transmitter circuitry for transmitting a wireless signal when button 103 is depressed.

Figure 5:
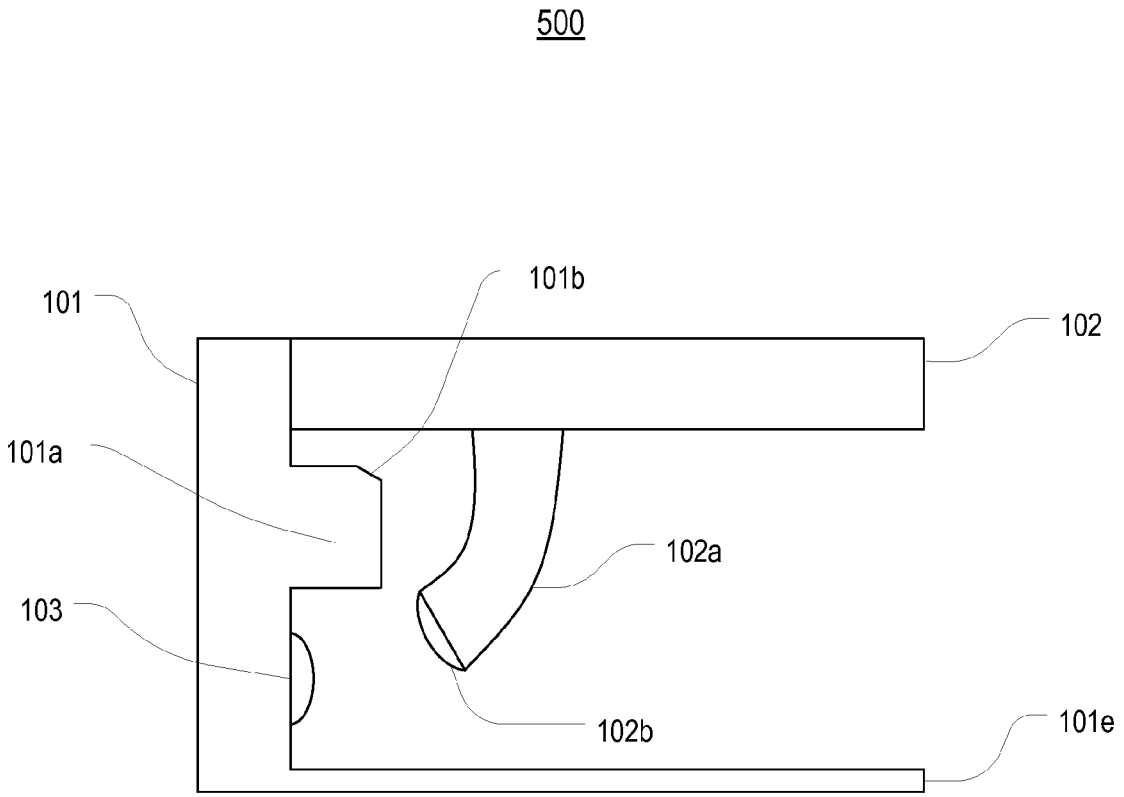
FIG. 5 illustrates a side view of an alternate configuration of a foot actuated doorbell button assembly in which the assembly can be mounted directly to the ground.

FIG. 5 illustrates an alternate embodiment where housing 101 includes a mounting plate 101*e* that acts as an extension of bottom surface 101*d*. Mounting plate 101*e* can facilitate mounting housing 101 directly to the ground or flooring surface. For example, mounting plate 101*e* can include an adhesive on its bottom surface or can include one or more holes through which fasteners may extend. Although in FIG. 5 housing 101 is shown as having a reduced height, in embodiments where housing 101 includes mounting plate 101*e*, housing 101 may also have a similar height as shown in FIG. 1A.

Figure 6A:
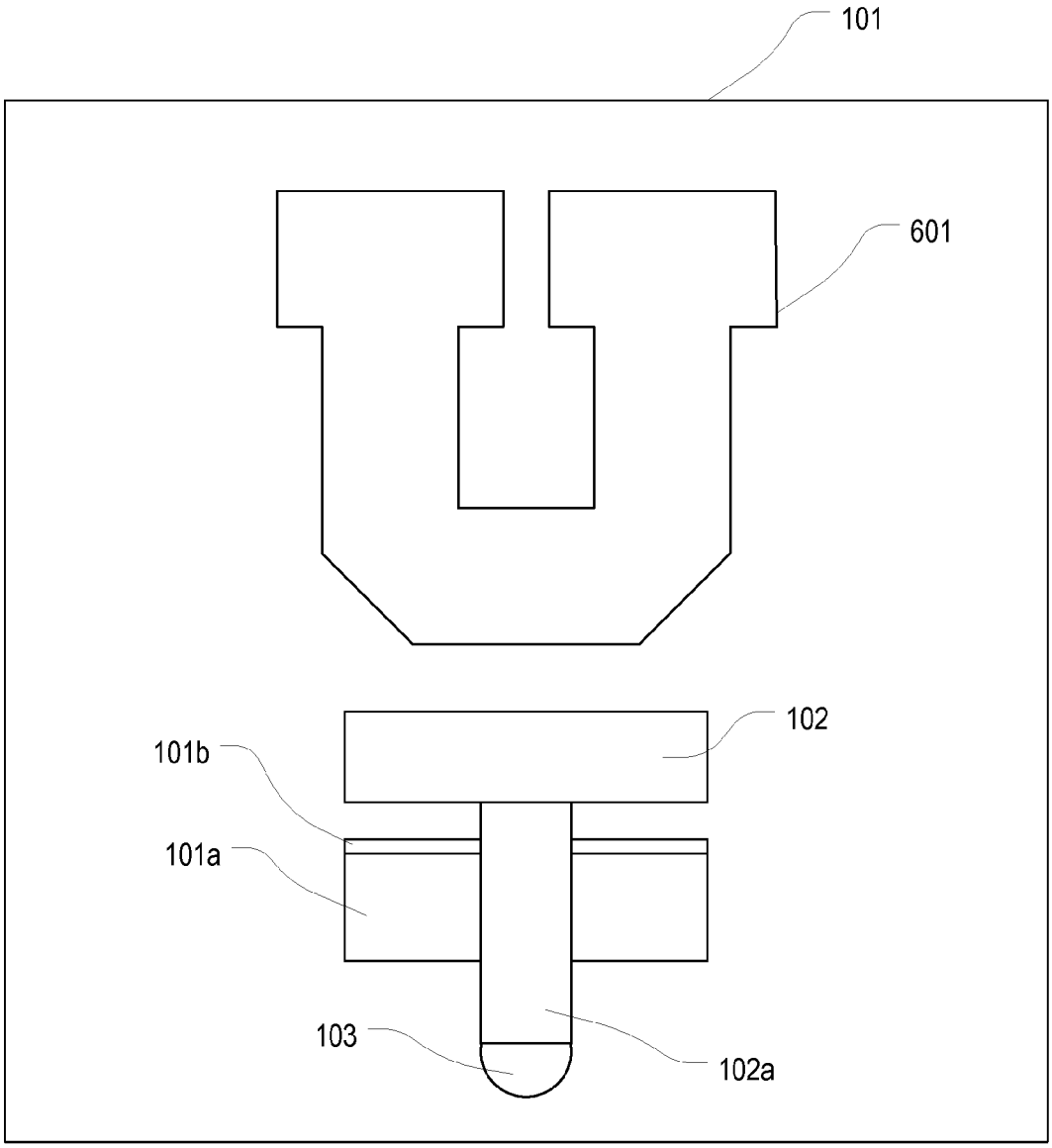
FIGS. 6A and 6B illustrate how a foot actuated doorbell button assembly can include a logo.
Figure 6B:
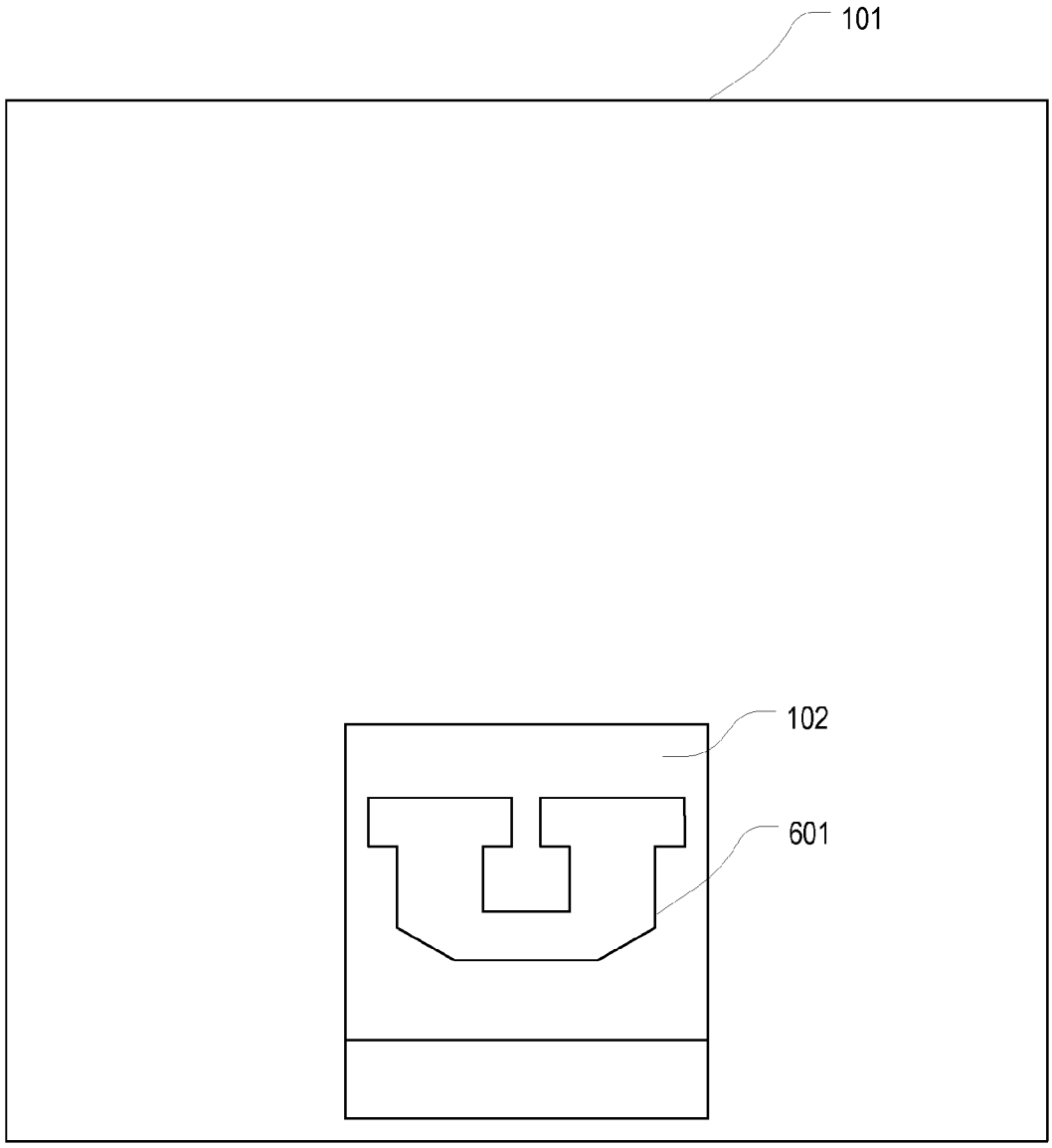

In some embodiments, housing 101 and pedal 102 (or their external surfaces) may be formed of a material that allows a decorative design to be formed thereon. For example, housing 101 and pedal 102 may be formed of a metal or plastic on which a logo may be printed or engraved. FIGS. 6A and 6B illustrate embodiments where a logo is formed on the front surface of housing 101 and the top surface of pedal 102 respectively.

Although the figures depict assemblies where the pedal is narrower than the housing, in some embodiments of the present invention, the pedal may be as wide as or wider than the housing. Similarly, in some embodiments, the housing can have any shape or size desirable including when the housing has a mounting plate similar to mounting plate 101*e*.

Although the figures and the above description describe the use of a button, a foot actuated doorbell button assembly may be implemented without a button. For example, housing 101 may include an opening into which extension 102*a* inserts when pedal 102 is depressed. In such embodiments, the insertion of extension 102*a* into the opening may activate circuitry (e.g., by completing a circuit). As another example, housing 101 may include circuitry for sensing the proximity of extension 102*a* to housing 101 (e.g., via variations in capacitance). In such embodiments, the circuitry can detect when extension 102*a* has come within a specified proximity of housing 101 and activate appropriate circuitry to cause a sound to be emitted. Accordingly, a foot actuated doorbell button assembly is not limited to embodiments where a physical button is depressed, but includes any embodiment where depressing pedal 102 causes extension 102*a* to approach or contact housing 101 thereby activating circuitry for causing a sound to be emitted.

Figure 7:
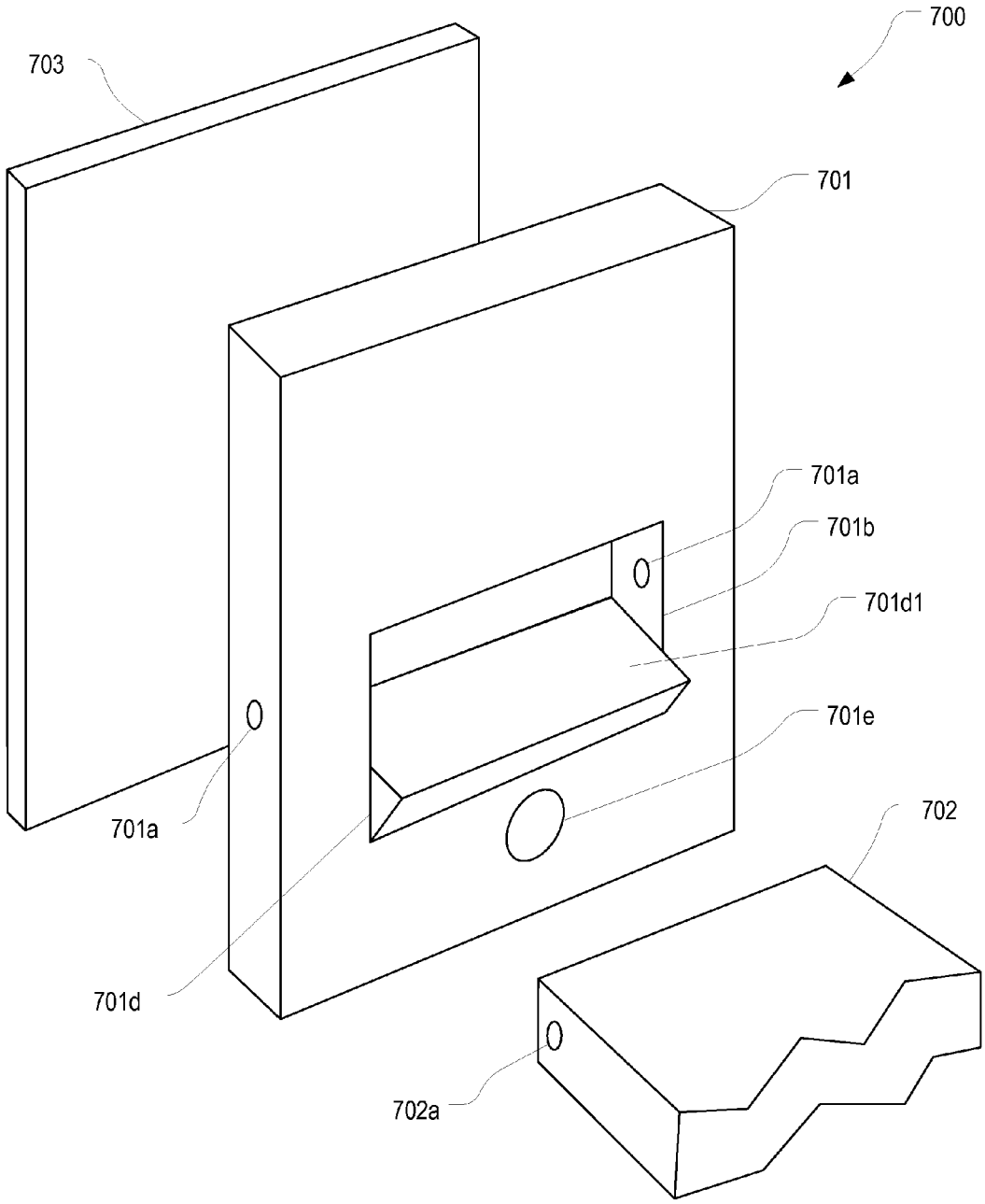
FIG. 7 illustrates another example of a foot actuated doorbell button assembly in accordance with one or more embodiments of the invention.

FIG. 7 illustrates another example of a foot actuated doorbell button assembly 700 in accordance with one or more embodiments of the present invention. Assembly 700 can function in a similar manner as assembly 100 as described above. In particular, assembly 700 includes a housing 701 and a pedal 702 (of which only a portion is shown). Assembly 700 may also include a plate 703 which can be mounted to a wall surface. Housing 701 can be configured to couple to plate 703. In this way, housing 701 does not couple directly to the wall surface which may facilitate removing housing 701 from the wall surface to replace components of assembly 700.

Housing 701 can be coupled to plate 703 in any suitable manner such as via screws, coupling surfaces, magnets, etc. In some embodiments, plate 703 may have an outer dimension that is less than an outer dimension of housing 701 so that plate 703 may insert at least partially inside a cavity formed in the back surface of housing 701. Plate 703 can be configured to couple to a wall surface in any suitable manner.

As shown in FIG. 7, housing 701 includes an opening 701*b* into which pedal 702 inserts. Holes (or channels) 701*a* may be formed within a wall of opening 701*b* and, in some cases, may extend through an outer surface of housing 701 such as is shown in FIG. 7. A corresponding hole or holes 702*a* may be formed through pedal 702. One or more rods (not shown) may be inserted through these holes to retain pedal 702 within opening 701*b*. In some cases, the one or more rods may be configured with springs or other structures to bias pedal into the unactuated position. Alternatively, pedal 702 may be biased by one or more external springs to push or pull pedal 702 into the unactuated position such as is shown in FIG. 3B.

Housing 701 includes a protrusion 701*d* which provides the same function as protrusion 101*a* described above. Protrusion 701*d* may be positioned such that its top surface forms an extension of a bottom wall of opening 701*b*. The resulting surface 701*d*1 can be angled downwardly to correspond to an angle in which pedal 702 will be oriented when in the actuated position. Accordingly, surface 701*d*1 functions to limit the downward movement of pedal 702.

In some embodiments, housing 701 may not include protrusion 701*d*. In such cases, the bottom wall of opening 701*b* may still be angled downwardly to provide a surface for limiting the downward movement of pedal 702. However, by employing protrusion 701*d* to create surface 701*d*1, a larger surface area can contact pedal 702 to limit its downward movement.

Although not shown, pedal 702 can include an extension similar to extension 102*a* for pressing or otherwise actuating a doorbell button. Housing 701 includes an opening 701*e* through which a doorbell button may extend. A back surface of housing 701 may be hollowed out around opening 701*e* to allow a standard-sized doorbell assembly to be placed therein with the doorbell button extending out through opening 701*e*. In this way, assembly 700 can easily be employed with standard doorbell assemblies. Preferably, a wireless doorbell assembly could be employed so that no wiring is required to install assembly 700 for use.

One benefit of the configuration of assembly 700 is that, because housing 701 can be removed from plate 703, pedal 702 and the doorbell assembly can be easily removed from housing 701. For example, if the battery of a wireless doorbell assembly dies, housing 701 can be removed to provide easy access to the doorbell assembly. Also, by removing housing 701 from plate 703, the interface between pedal 702 and housing 701 can be easily accessed to enable removal of pedal 702 (e.g., by removing rods from holes 701*a*, 702*a*). This can allow pedal 702 to be easily customized or replaced.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A foot actuated doorbell button assembly comprising:
a housing;
a button contained within the housing, the button configured to cause a doorbell to be actuated when the button is depressed; and
a pedal that extends out from the housing, the pedal being coupled to the housing in a pivoting connection, the pivoting connection biasing the pedal into an unactuated position and allowing the pedal to be depressed downwardly into an actuated position, the pedal including an extension that depresses the button when the pedal is depressed into the actuated position, wherein the pivoting connection includes a spring hinge positioned within the housing and the pedal or an external spring
wherein the housing includes a protrusion that limits the downward movement of the pedal, the protrusion including a chamfered surface, an angle of the chamfered surface matching an angle of the pedal when the pedal contacts the protrusion, the housing including an opening into which the pedal inserts, the chamfered surface forming a bottom wall of the opening.

2. The assembly of claim 1, wherein the housing forms a mounting plate for mounting the housing to a wall.

3. The assembly of claim 1, wherein the housing includes an extension that forms a mounting plate, wherein the mounting plate extends outwardly from the housing at an angle, wherein a bottom surface of the mounting plate includes one or more means for mounting the housing to a surface on which the assembly is placed.

4. The assembly of claim 1, wherein the extension is curved towards the housing to allow the extension to contact and depress the button when the pedal is depressed downwardly into the actuated position.

5. The assembly of claim 1, where in the extension includes a tip formed of a compressible material.

6. The assembly of claim 1, wherein the housing includes a switch that is actuated when the button is depressed.

7. The assembly of claim 6, wherein the housing includes a transmitter for wirelessly transmitting a signal that indicates that the button was depressed.

8. A foot actuated doorbell button assembly comprising:
a housing; and
a pedal that extends out from the housing, the pedal being coupled to the housing in a pivoting connection, the pivoting connection biasing the pedal into an unactuated position and allowing the pedal to be depressed downwardly into an actuated position, the pedal including an extension that approaches or contacts the housing when the pedal is depressed to cause a sound to be emitted from a door bell, wherein the extension curves towards the housing;
wherein the housing includes a protrusion that limits the downward movement of the pedal, the protrusion including a chamfered surface, an angle of the chamfered surface matching an angle of the pedal when the pedal contacts the protrusion, the housing including an opening into which the pedal inserts, the chamfered surface forming a bottom wall of the opening.

9. The assembly of claim 8, wherein the circuitry includes a switch that is closed when the extension contacts the housing.

10. The assembly of claim 8, wherein the extension inserts into a second opening in the housing when the pedal is depressed.

11. The assembly of claim 8, wherein the extension includes a tip comprised of a compressible material.

12. The assembly of claim 8, wherein the circuitry includes a transmitter for transmitting an indication that the extension has approached or contacted the housing.

* * * * *